United States Patent [19]

Christian

[11] 4,206,845

[45] Jun. 10, 1980

[54] FOOD CONTAINER

[75] Inventor: Hubert E. Christian, Phoenix, Ariz.

[73] Assignee: Dart Industries Inc., Los Angeles, Calif.

[21] Appl. No.: 964,239

[22] Filed: Nov. 27, 1978

Related U.S. Application Data

[63] Continuation of Ser. No. 830,508, Sep. 6, 1977, abandoned.

[51] Int. Cl.[2] ..... B65D 21/02; A47G 19/02; B65D 43/10

[52] U.S. Cl. ..... 206/508; 150/0.5; 206/519; 220/70; 220/306; 220/366; 220/4 B; 229/2.5 R

[58] Field of Search ..... 206/508, 518, 519; 220/4 B, 4 E, 366, 66, 70; 229/2.5; 150/0.5

[56] References Cited

U.S. PATENT DOCUMENTS

| | | | |
|---|---|---|---|
| 2,379,680 | 7/1945 | Burdick | 206/508 |
| 3,107,027 | 10/1963 | Hong | 229/2.5 |
| 3,303,964 | 2/1967 | Luker | 206/519 |
| 3,326,408 | 6/1967 | Ringlen | 206/518 |
| 3,450,301 | 6/1969 | Stec | 206/508 |
| 3,708,086 | 1/1973 | Colato | 220/366 |
| 3,794,090 | 2/1974 | Commisso | 220/366 |
| 3,797,694 | 3/1974 | See | 220/366 |
| 3,815,736 | 6/1974 | Sedlak | 229/2.5 |
| 3,981,401 | 9/1976 | Blanchard | 206/519 |
| 4,061,241 | 12/1977 | Retelny | 229/2.5 |

FOREIGN PATENT DOCUMENTS

| | | | |
|---|---|---|---|
| 676092 | 10/1961 | Italy | 206/508 |

*Primary Examiner*—George E. Lowrance
*Attorney, Agent, or Firm*—Kenneth J. Hovet

[57] ABSTRACT

A food container suited for use in carry out food service having a base and cover. Each container portion is of tapered construction to permit stacking upon itself for storage and each has stop members formed thereon to determine stack height. Catch structure is formed on the cover which interlocks with resilient lip structure formed around the upper periphery of the base to detachably lock the container and base in an assembled state. The container base forms a shallow hollow of sufficient depth to prevent spillage, but is sufficiently flat to permit use as a plate which can be eaten upon with knife and fork. The resilient lip structure defines, when interlocked with the cover, vents which provide air circulation in the closed container to prevent condensation therein. Formed on the top of the cover and the bottom of the base is interfitting structure operable to retain one assembled container stably stacked on another with food contained therein. The container portions are preferably made of inexpensive heat insulative material to keep food warm and also be disposable.

6 Claims, 11 Drawing Figures

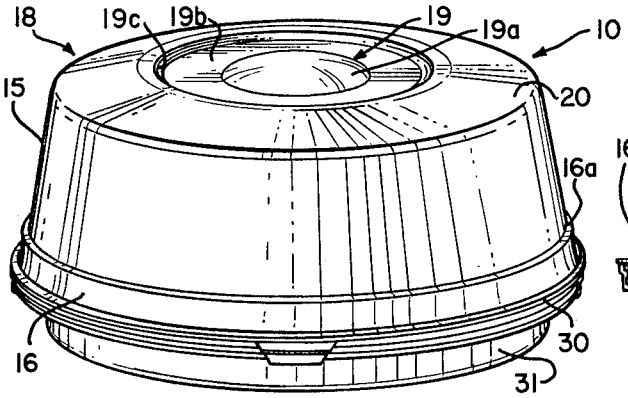
FIG.1
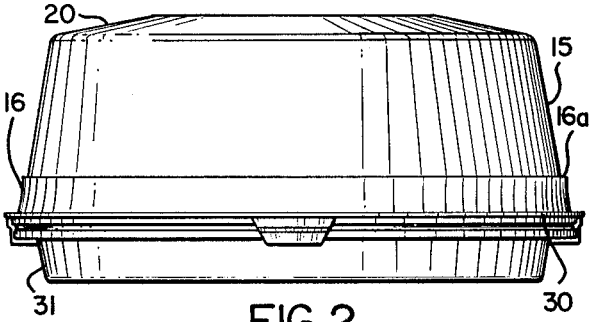
FIG.2
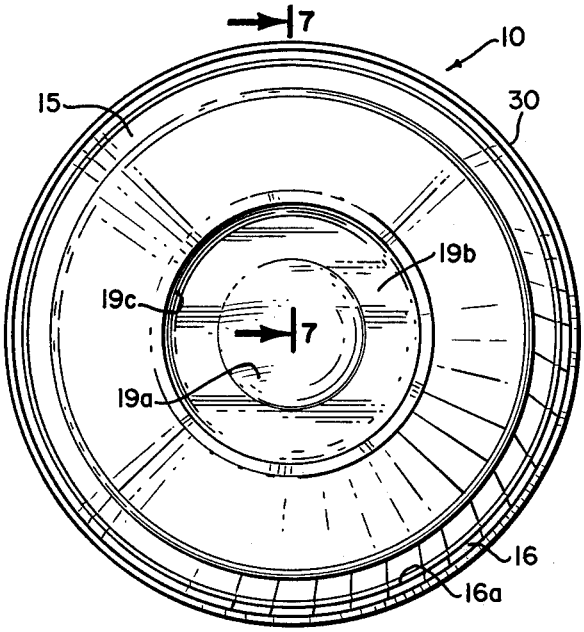
FIG.3
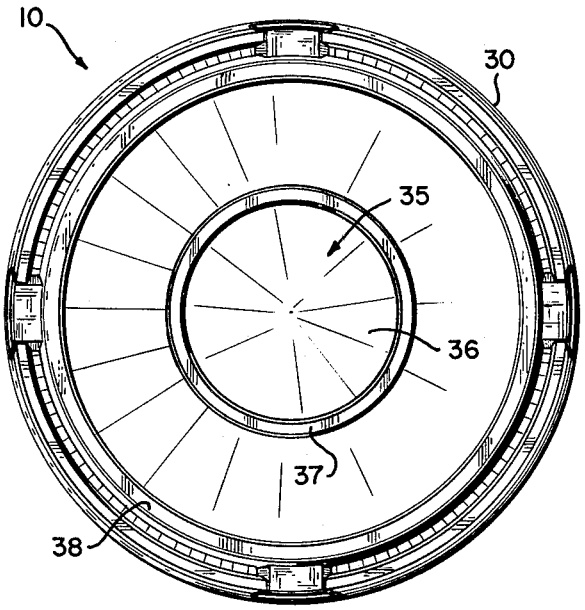
FIG.4
FIG.5
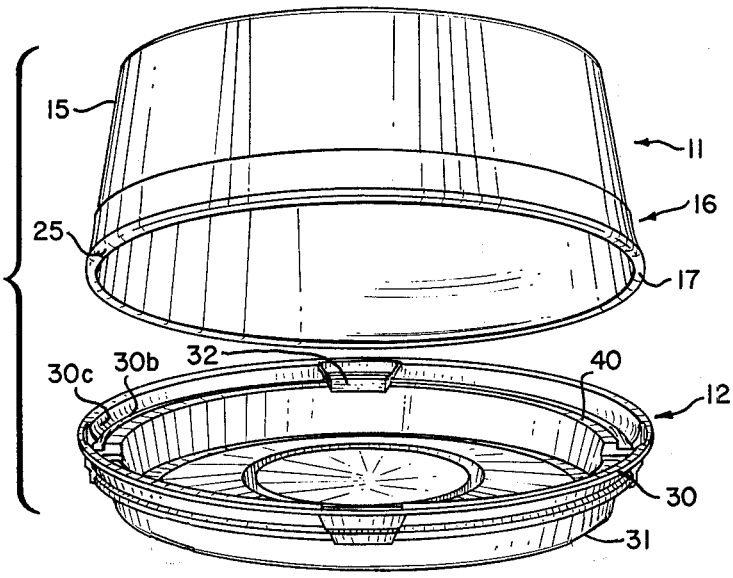

FOOD CONTAINER

This is a continuation of application Ser. No. 830,508, filed Sept. 6, 1977, now abandoned.

BACKGROUND OF THE INVENTION

The present invention relates to food containers, and more particularly to an improved food container suited for use in providing carry out food services.

SUMMARY OF THE INVENTION

It is an object of the present invention to provide an improved food container suited for use in providing carry out food service.

It is further an object of the present invention to provide an improved food container as set forth characterized by havng base and cover portions of improved construction which when assembled provide food containers readily and stably stackable one upon another which may be carried when so stacked with food contained therein and which when disassembled are capable of being stacked compactly for convenient storage.

It is also an object of the present invention to provide an improved food container as set forth capable of maintaining food warm while preventing condensation therein so as to avoid condensate from forming on warm food.

It is additionally an object of the present invention to provide an improved food container as set forth having a base of improved construction suitable for use as a plate which may be eaten upon with a knife and fork.

It is another object of the present invention to provide an improved food container as set forth having a base of improved construction which prevents spillage of food contained therein.

It is yet another object of the present invention to provide an improved food container as set forth characterized by having base and cover portions which may be detachably secured together.

It is still another object of the present invention to provide an improved food container as set forth characterized by being of inexpensive construction so as to be disposable.

In accomplishing these and other objects, there has been provided a food container suited for use in carry out food service. The food container provided is made up of a base portion and a cover portion. Each of these container portions is of tapered construction to permit stacking of a base portion on a base portion and a cover portion on a cover portion, for storage, and has stop members formed thereon to determine stack height. Catch structure is formed on the cover portion which interlocks with resilient lip structure formed around the upper periphery of the base portion to detachably latch the container cover and base in an assembled state.

The container base is formed as a shallow hollow of sufficient depth to prevent food spillage, but is sufficiently flat, rigid and durable to permit one to use same as a plate which can be eaten upon with knife and fork. The resilient lip structure further defines, when interlocked with the cover portion, vents which provide air circulation in the closed container to prevent condensation therein.

Formed centrally in the top of the cover portion and the bottom of the base portion is interfitting structure operable to retain one assembled container stably stacked on another with food contained therein. The container portions are preferably made of inexpensive heat insulative material to keep food warm and also be disposable.

Additional objects of the present invention reside in the specific construction of the exemplary food container hereinafter particularly described in conjunction with the several drawing figures.

BRIEF DESCRIPTION OF THE DRAWINGS

FIG. 1 is a perspective view of an assembled food container according to the present invention.

FIG. 2 is a side elevation view of the assembled food container of FIG. 1.

FIG. 3 is a top view of the assembled food container of FIG. 1.

FIG. 4 is a bottom view of the food container of FIG. 1.

FIG. 5 is an exploded view of the food container of FIG. 1.

DETAILED DESCRIPTION OF THE PREFERRED EMBODIMENT

Figure 6:
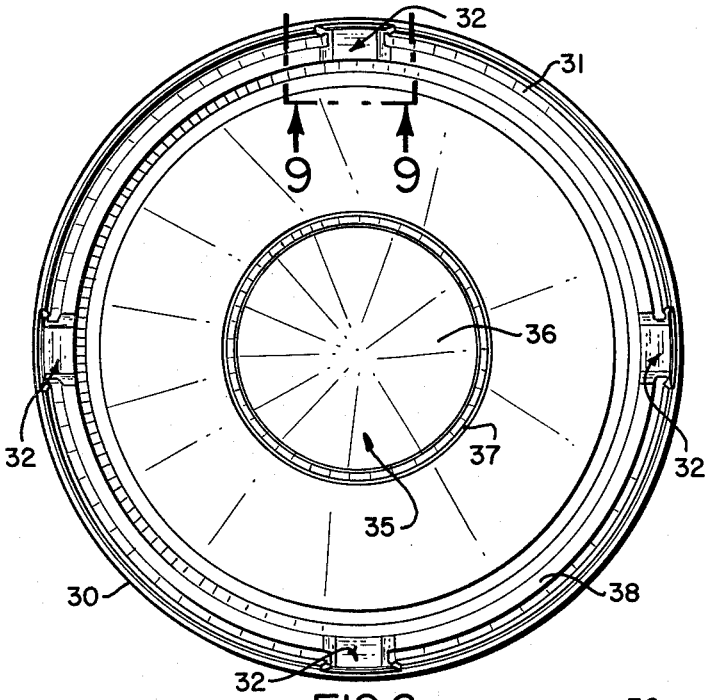
FIG. 6 is a top plan view of the base portion of the food container of FIG. 1.
Figure 7:
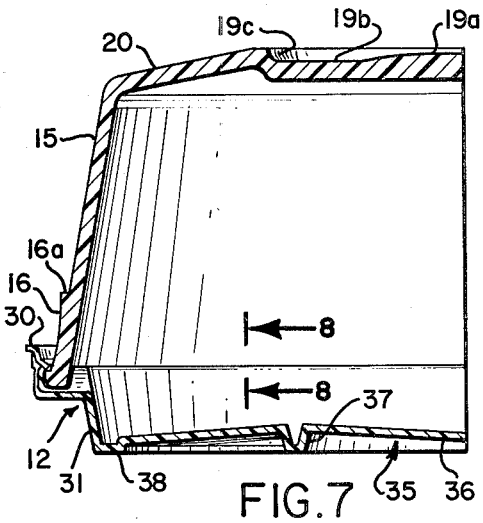
FIG. 7 is a view taken along line 7—7 of FIG. 3.

Referring to the drawings in more detail, there is shown a food container generally identified by the numeral 10. The container 10 is made up of a cover portion or structure 11 and base portion or structure 12. The upper side of the base 12 defines a shallow hollow for holding food to be served while the lower side of the cover 11 defines a bowl shaped cover for covering the upper side of the base 12.

Figure 10:
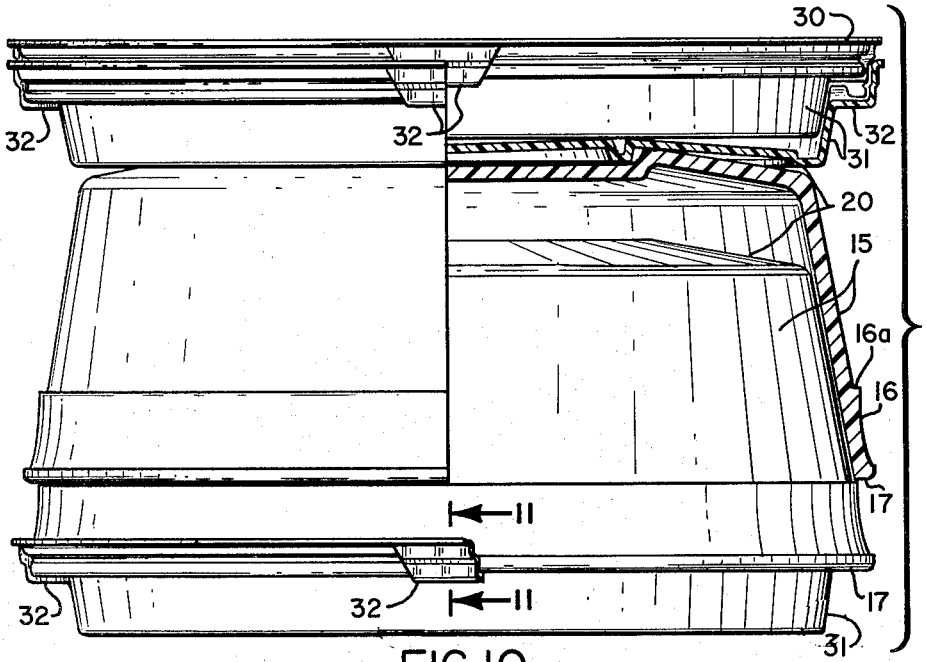
FIG. 10 is a side elevation view partially cutaway illustrating the manner in which one assembled food container is stacked on another as well as the manner in which the container base and cover portions are stacked on themselves.
Figure 11:
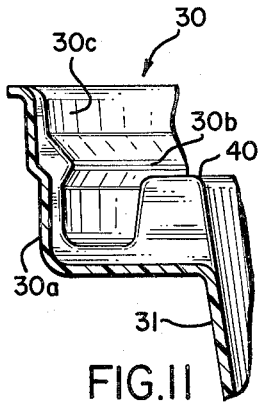
FIG. 11 is a view taken along the line 11—11 of FIG. 10.

As shown by the drawings, the cover portion 11 is generally circular in shape, but tapered as shown by FIG. 10, to permit the stacking of one cover 11 on another. The cover 11 has a side wall 15 the shape of which corresponds to a downwardly expanding truncated cone. Along the lower outer peripheral surface of the side wall 15 is formed ledge structure 16 of uniform height which defines ledge 16A and functions as shown in FIG. 10, to support one cover 16 stacked on another, with the lower cover edge 17 resting on the ledge 16A. The height of the ledge structure 16 defines and determines the stack height of one cover 11 on another.

The cover 11 is closed by a circular top end structure 18 which has a well or recess 19 formed centrally therein. The well 19 is formed by a central circular concave surface 19A and a substantially flat annular surface 19B which extends substantially normal to the center axis of the cover 11. The circular well 19 is closed by a rounded, curved wall surface 19C. The portion of the top 18 surrounding the well 19 is formed by a downwardly sloping annular surface 20.

Formed as an integral part of the cover ledge structure 16 and defining its lower rim portion is catch structure 25. As shown by FIGS. 5, 7, 8 and 10, the catch structure 25 defines a surface 25A extending substantially normal to the axis of the cover 10 over which lip structure 30 on the base 12 may catch or be latched, so as to detachably secure the base 12 and cover 11 together to form an assembled container 10.

Figure 8:
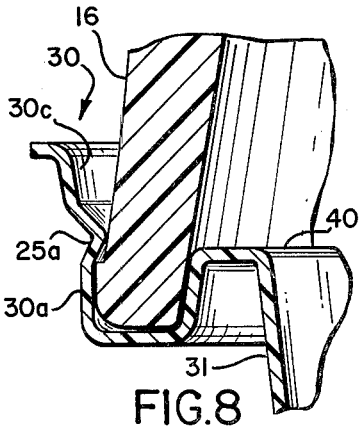
FIG. 8 is a view taken along line 8—8 of FIG. 7.

As shown by the drawings, the base 12 is generally circular in shape, but is tapered as shown in FIG. 10 to permit the stacking of one base 12 on another. The base 12 has a side wall 31, the shape of which corresponds to an upwardly expanding truncated cone. Along the upper peripheral portion of the side wall 31 is formed the lip structure 30 which latches upon the cover catch structure 25. The lip structure 30 includes a lower groove portion 30A bounded by a lip 30B. The catch structure 25, as illustrated by FIG. 8, is latched within the groove portion 30A by the lip 30B. The upper portion 30C of the lip structure 30 expands and flares outwardly slightly so that the lip 30B defines stop or support structure upon which one base 12 may be stacked on another, as shown in FIG. 10. The height of the lip structure 30B above the inner upper rim 40 of the base 12 defines the stack height of one base 12 on another.

Figure 9:
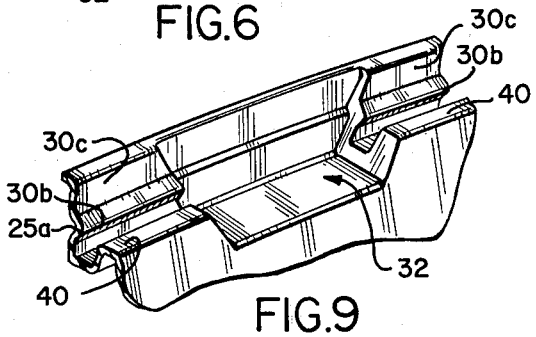
FIG. 9 is a view taken along the line 9—9 of FIG. 6.

As shown by FIGS. 6 and 9, recesses or depressions 32 are formed in the lip structure 30 at selected points around its periphery to define channels through which air may circulate between the interior and exterior of the container 10 when the cover 11 and base 12 are latched together. Four channels 32 are illustrated in FIG. 6 formed ninety degrees apart around the periphery of the base 12, although any suitable number of channels 32 could be formed in the lip structure 30. The channels 32 flare slightly outward and extend under and around the outside of the lower edge portion of the cover 11. The channels 32 function to define vents which reduce and diminish the formation of condensate in the container 10 when closed with warm food therein.

As shown in the drawings, a circular cavity 35 is formed centrally in the bottom end of the base 12. The cavity 35 is defined by a transversely extending wall 36 surrounded by a side wall or rim 37. The cavity rim structure 37 interfits within the well or recess 19 of the cover 11 and operates to stably support the base 12 on a cover 11.

A cylindrical supporting rim 38 is also formed on the base 12 as a downward extension of the base side wall 31. The outer supporting rim 38 cooperates with the inner supporting rim 37 to act as foot structure to stably support the base 12 on a flat surface, the lower edges of the rims 37 and 38 lying in a common plane normal to the base center axis.

It is noted that the relatively flat and shallow construction of the base 12, while being closed on its sides to prevent food spillage, permits one to readily remove food therefrom, or to use same as a plate to eat upon. Additionally, the closed container of greater depth defined by the lower or under side of the cover 11 may be turned over and used as a bowl for serving and eating soup. In this regard note that the base 12 may then function as a lid and be used as a food carry-out. It will also be appreciated that the closed container can be stacked in an upside down position, i.e., the assembly of FIG. 10 can be inverted and utilized as aforementioned.

It is further noted that both the cover 11 and base 12 are preferably made of an inexpensive heat insulative material so as to keep food warm and also be disposable. In a food container 10 constructed, particularly suited for use for serving hamburgers, the cover 11 was made of styrofoam while the base 12 was made of a durable and sufficiently rigid polystyrene sheet material which could be eaten upon with a knife and fork.

Although the invention has been described herein in the form of a preferred embodiment, it is recognized that departures may be made therefrom within the scope of the present invention.

What is claimed is:

1. A food container, comprising: base structure, said base structure having an upper side and bottom end, the upper side of said base structure defining a hollow for holding food to be served said bottom end including foot structure comprising concentric inner and outer U-shaped rims having lower edges lying in a common plane; cover structure, said cover structure having a top end and under side bounded by a lower edge, the under side of said cover structure defining a bowl shaped cover for covering the upper side of said base structure and food held therein; said cover structure tapering outwardly from its top end towards its lower edge so that one of said cover structures may be stacked on another including; first stop means formed on said cover structure for determining the stack height of one of said cover structures on another; said first stop means comprising a thickened intermediate portion of said tapered cover structure defining an outwardly extending ledge above said catch structure; latch means associated with said base and cover structures for detachably securing the lower edge of said cover structure upon the upper side of said base structure to form an assembled food container, said latch means being operable to substantially seal said assembled food container against food spillage comprising catch structure formed around the outer periphery of the lower edge of said cover structure; said catch structure comprising a thickened annular band area about the lower rim portion defining an outwardly extending ledge; and resilient lip structure formed around the outer periphery of the upper edge of said base structure, said lip structure defining an upwardly opening groove having an inwardly directed annular lip over which said thickened lower rim portion interfits and being operable to detachably latch thereon.

2. The invention defined in claim 1, wherein said lip structure has recesses formed therein which define channels across said upwardly opening groove and around and under said catch structure when said catch structure is latched within said groove, said channels defining vents through which air may circulate between the inside and outside of said food container when assembled.

3. The invention defined in claim 1, wherein: said base structure tapers outwardly from its bottom end towards its upper edge so that one of said base structures may be stacked on another; and including: second stop means formed on said base structure for determining the stack height of one of said base structures on another defined as an upward outwardly flaring continuation of said lip structure.

4. The invention defined in claim 1, wherein said interfitting structure formed on the bottom and top ends of said base and cover structures for holding one of said assembled containers stably stacked upright on another comprises interfitting recess means and rim means formed, respectively, centrally in the top end of said cover structure and centrally on the bottom end of said base structure.

5. The invention defined in claim 1, wherein: the food holding hollow defined by the upper side of said base structure is shallow; and said base structure is made of a rigid and durable material which can be eaten upon with a knife and fork whereby said base structure may be used as a plate.

6. The invention defined in claim 1, wherein said base and cover structures are each of substantially circular configuration.

* * * * *